US006227886B1

(12) United States Patent
Baker et al.

(10) Patent No.: US 6,227,886 B1
(45) Date of Patent: May 8, 2001

(54) SNAG-RESISTANT PATCHCORD PLUG LATCH AND COVER

(75) Inventors: Frank P. Baker, Chatham; Theodore A. Conorich, Parsippany Township, Morris County; William J. Ivan, Woodbridge, all of NJ (US); Richard L. Case, Omaha, NE (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/329,395

(22) Filed: Jun. 10, 1999

Related U.S. Application Data

(60) Provisional application No. 60/129,624, filed on Apr. 16, 1999.

(51) Int. Cl.[7] ..... H01R 13/44

(52) U.S. Cl. ..... 439/142

(58) Field of Search ..... 439/49, 501, 696, 439/709, 142, 717, 76.1, 676, 351, 296, 343

(56) References Cited

U.S. PATENT DOCUMENTS 5,718,604 2/1998 Conorich et al. .

OTHER PUBLICATIONS

Product Application Guide, *110 Connector Systems for Premises Application*, Issue 4, Apr. 1994.

*Primary Examiner*—Neil Abrams
*Assistant Examiner*—J. F. Duverne
(74) *Attorney, Agent, or Firm*—Gibbons, Del Deo, Dolan, Griffinger & Vecchione

(57) ABSTRACT

A reverse-engaging patchcord plug has a rearward-facing connector channel, and is used in connection with a wiring block assembly. A cover pivots between two positions. In the first position covering the channel, the hook-shaped channel will not snag on the wiring while being pulled out of troughs. A detent releasably retains the cover in the first position. In the second position uncovering the channel, the plug will engage the connecting block to allow signals to be conducted between them. A latch is attached to the plug. With the cover in the second position, the latch has a hook that engages a strike attached to the wiring block assembly for retaining the plug on the wiring block assembly. The latch is resilient, requiring minimal applied force to secure and release.

9 Claims, 4 Drawing Sheets

SNAG-RESISTANT PATCHCORD PLUG LATCH AND COVER

CROSS REFERENCE TO RELATED APPLICATIONS

This application claims the benefit of U.S. Provisional Application Ser. No. 60/129,624, filed on Apr. 16, 1999. This application is related to copending application Ser. No. 09/329,439 entitled "Anti-Snag Patchcord Plug Latch And Cover" filed on Jun. 10, 1999.

FIELD OF THE INVENTION

This invention relates to the field of telecommunications, and more particularly to connectors for use in telecommunication systems.

BACKGROUND OF THE INVENTION

The telecommunications and data management industries utilize connective hardware for general building wiring, premises distribution systems, local area networks, and other network applications. The connective hardware known as the 110 Connector Systems has become a standard of the industry because of the reliable gas-tight connection provided by the 110 Insulation Displacement Connector. This miniature quick-connect terminating system is listed or approved by Underwriters Laboratories, the Canadian Standards Association, and the Australian Standards Association. The 110 Connector Systems have gained type approval from such countries as the United Kingdom, Japan, Korea, and others.

The 110 Connector System consists of field-wired cable termination apparatus that is used to organize and administer cable and wiring installations. The main cross-connect is typically located in the equipment room and provides termination and cross-connection of network interface equipment, switching equipment, processor equipment, and backbone (riser or campus) wiring. The horizontal cross-connect is typically located in the telecommunications closet and provides termination and cross-connection of horizontal (to the work area) and backbone wiring. Cross-connects provide efficient and convenient routing and rerouting of common equipment circuits to various parts of a building or campus.

The 110 Connector Systems enable cable and wiring installations to be handled by technical or non-technical end user personnel. Line moves and rearrangement for the cabling termined at a cross connect can be performed with patchcords (plug-ended jumpers) or cross-connect wire. The patchcords are used where the highest system integrity is required.

Referring to FIG. 1, the 110 Connector System now include a new wiring block support structure known as a cable organizer 12 that replaces the old style wiring block. A conductor termination array (index strip) 14 is mounted upon the cable organizer 12. A cable cover 16 is juxtaposed with the cable organizer 12 to cover cable routing and provide a smooth surface to facilitate pulling out patchcord plugs. The cable organizer 12 elevates the index strip 14 to expand the jumper trough space between adjacent cable organizers. A plurality of connecting blocks 18 are plugged into the index strip 14 as needed. The patchcords are then plugged into the connecting blocks to make the desired connections and/or rearrangements.

The 110 patchcords are available now in two versions. The old version is a forward-engaging patchcord 20 that uses a forward-engaging plug 22 as shown in FIG. 2. This plug 22 engages the connecting block 18 in the direction of arrow 24. Hemispherical buttons 19 on the connecting blocks 18 and corresponding mating holes 23 in the plugs 22 form a detent latch to keep the patchcord 20 engaged. To prevent an accidental disconnection, and when deliberately removing a patchcord 20, a high force is required to overcome the detent latch retention. The patchcord 20 is then typically pulled out through a series of cordage holding troughs. When pulling the forward-engaging patchcord 20 out though a trough, the connection opening 21 faces away from the pulling direction, as shown by arrow 25 in FIG. 2.

The new version jumper is a reverse-engaging patchcord 26 that uses a reverse-engaging plug 28 as shown in FIG. 3. The connection opening 29 of the reverse-engaging plug 28 is opposite to that of the forward-engaging plug 22. The reverse-engaging plug 28 is further described in U.S. Pat. No. 5,718,604 entitled Patch Cord Connection System issued on Feb. 17, 1998 and is incorporated herein by reference. Plug 28 engages the connecting block 18 in the direction of arrow 30. Plug 28 is unplugged in the direction of arrow 32, and withdrawn from the trough by pulling in the direction of arrow 30.

SUMMARY OF THE INVENTION

In accordance with the present invention, there is provided a reverse-engaging patchcord plug, for use in connection with a wiring block assembly having a connecting block. The patchcord plug comprises a body extending between opposite first and second ends. The body has a channel facing toward the body second end. At least one connector is mounted within the channel. A conductor cord is attached to the connector and projects from the body second end, for conducting signals to the connector.

A cover is attached to the body, and extends between opposite proximal and distal ends. The cover is moveable between a first cover position covering the channel and a second cover position uncovering the channel. The cover has a first surface facing outward in the first cover position and an opposite second surface facing inward in the first cover position.

Thus, in the first cover position, the plug will be pulled through a trough without snagging on adjacent wiring. In the second cover position, the plug will slide in a direction of engagement to engage the connecting block and thereby allow signals to be conducted between the connector and the connecting block.

BRIEF DESCRIPTION OF THE DRAWING

A more complete understanding of the present invention may be obtained from consideration of the following description in conjunction with the drawing, in which.

DESCRIPTION OF THE PREFERRED EMBODIMENTS

Figure 1:
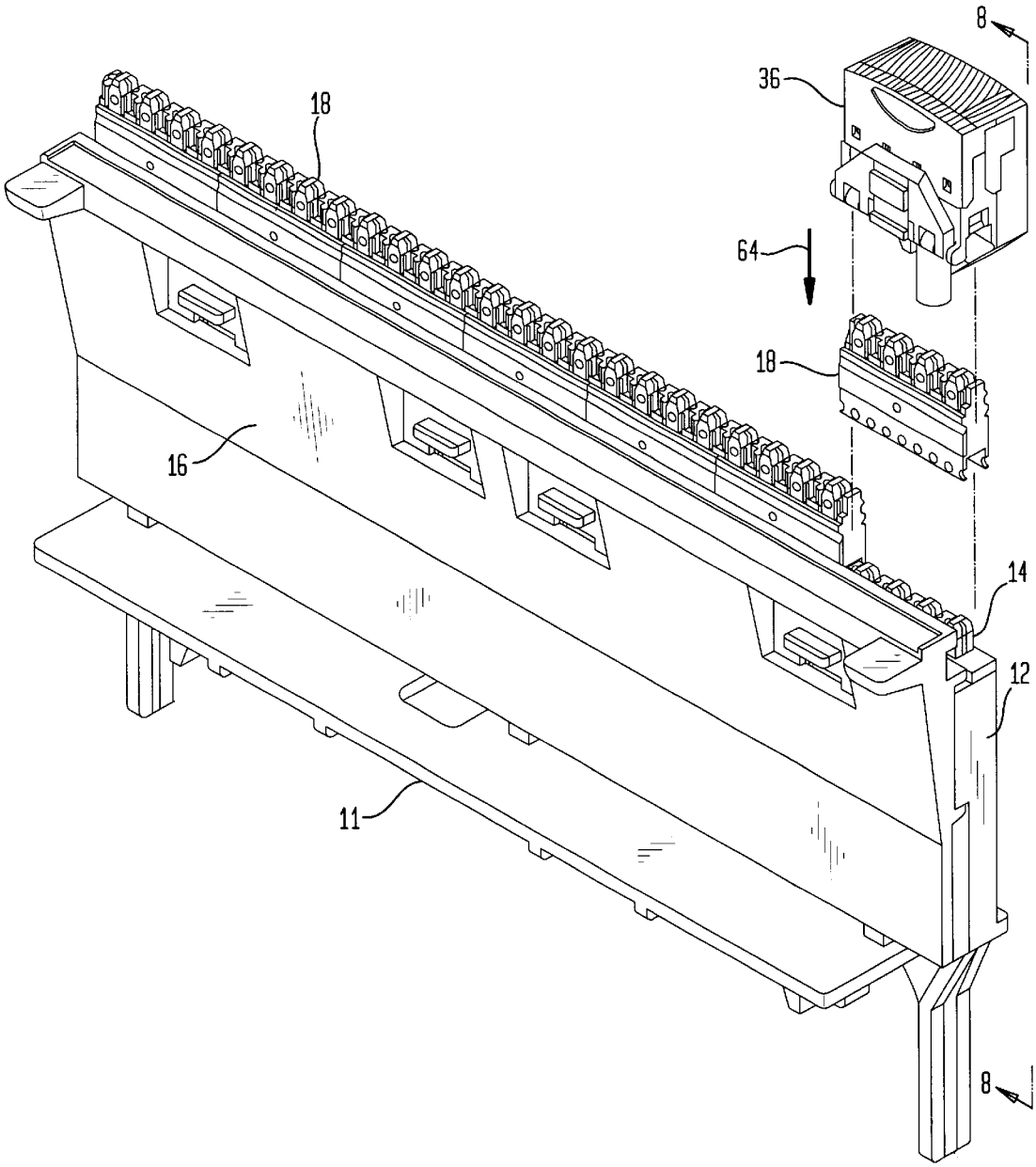
FIG. 1 is a perspective view of the new wiring block support structure known as a cable organizer, including an exploded assembly of a connection block and a reverse-engaging patchcord plug.
Figure 2:
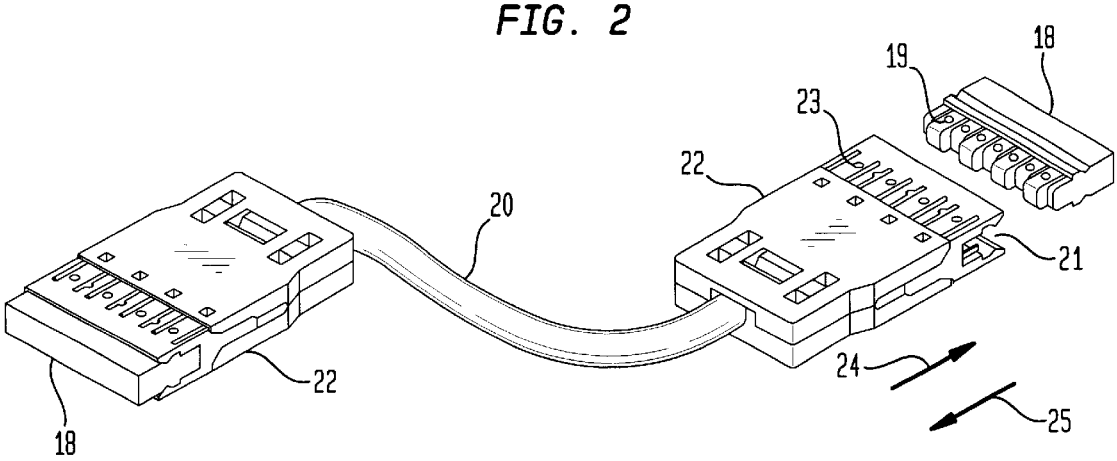
FIG. 2 is a perspective view of the forward-engaging patchcord.
Figure 3:
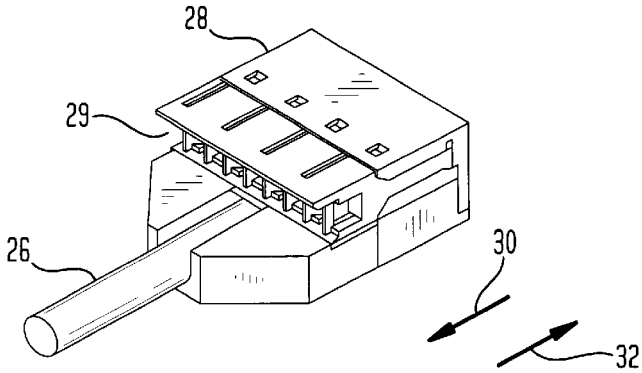
FIG. 3 is a perspective view of the new reverse-engaging patchcord plug.
Figure 4:
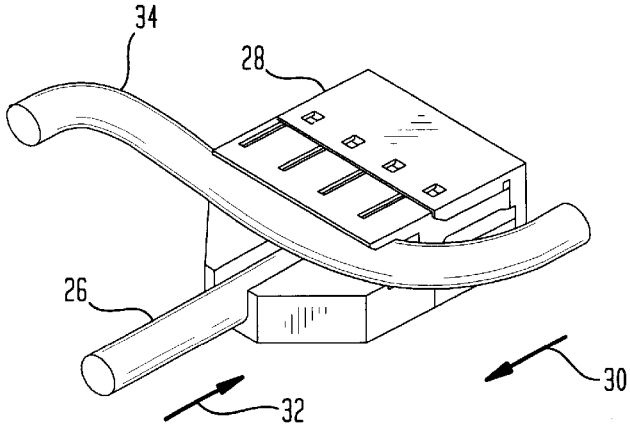
FIG. 4 is a perspective view of the new reverse-engaging patchcord plug, showing the plug snagging on adjacent wiring.

Referring now to the drawings, and especially to FIGS. 1 and 3, a reverse-engaging patchcord plug 36, is used in connection with a wiring block assembly 11 having a cable organizer 12, an index strip 14, a connecting block 18, and a cable cover 16. The profile view of plug 28 resembles a hook-like structure. During the removal of reverse-engaging patchcord 26, again by pulling it through the troughs, the hook shaped connection channel 29 can snag on wiring and cordage of other patchcords 34 in the trough, as shown in FIG. 4.

Referring to FIGS. 5, 6, 7, 8, and 9, there is a representative embodiment of the invention disclosed. The patchcord plug 136 is used in connection with a wiring block assembly 111 having a cable organizer 112, an index strip 114, a connecting block 118, and a cable cover 116. The patchcord plug 136 comprises a body 138 extending between opposite first 140 and second 142 ends. The body 138 has a channel 144 facing toward the body second end 142. At least one connector 146 is mounted within the channel 144. A conductor cord 148 is attached to the connector 146 and projects from the body second end 142, for conducting signals to the connector 146.

Figure 5:
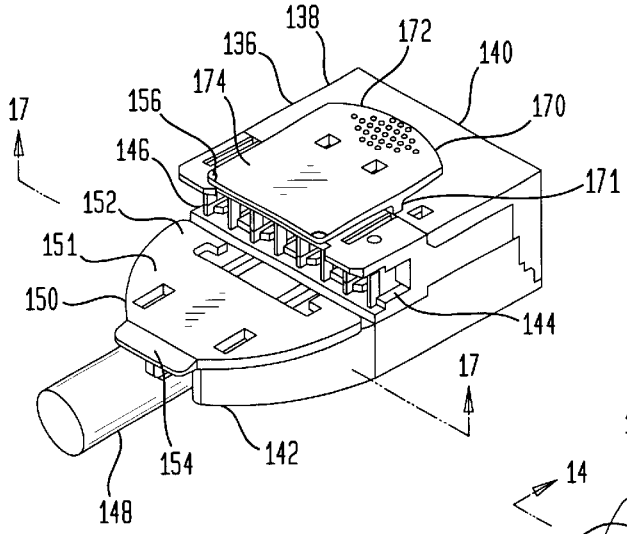
FIG. 5 is a perspective view of another embodiment of the new reverse-engaging patchcord plug having a latch and cover constructed in accordance with the invention, and showing the cover in the second position.
Figure 6:
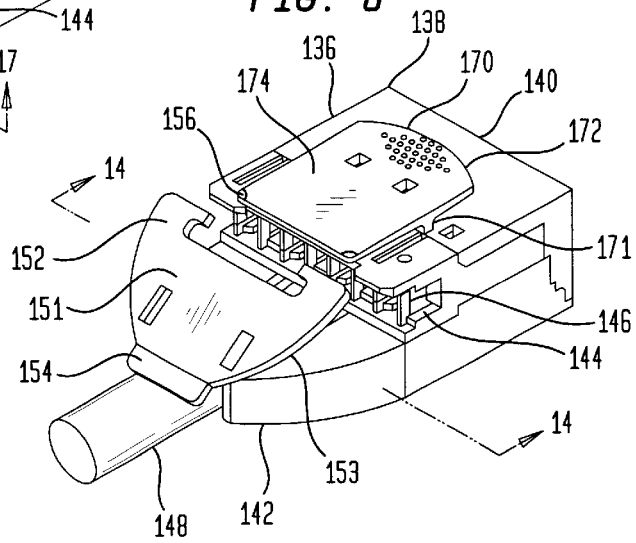
FIG. 6 is a perspective view of the plug of FIG. 5, showing the cover intermediate between the first and second positions.
Figure 8:
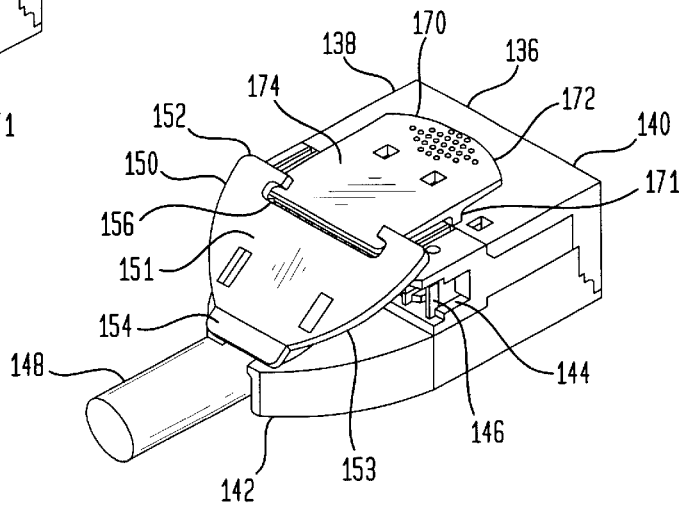
FIG. 8 is a perspective view of the plug of FIG. 5, showing the cover in the first position.
Figure 9:
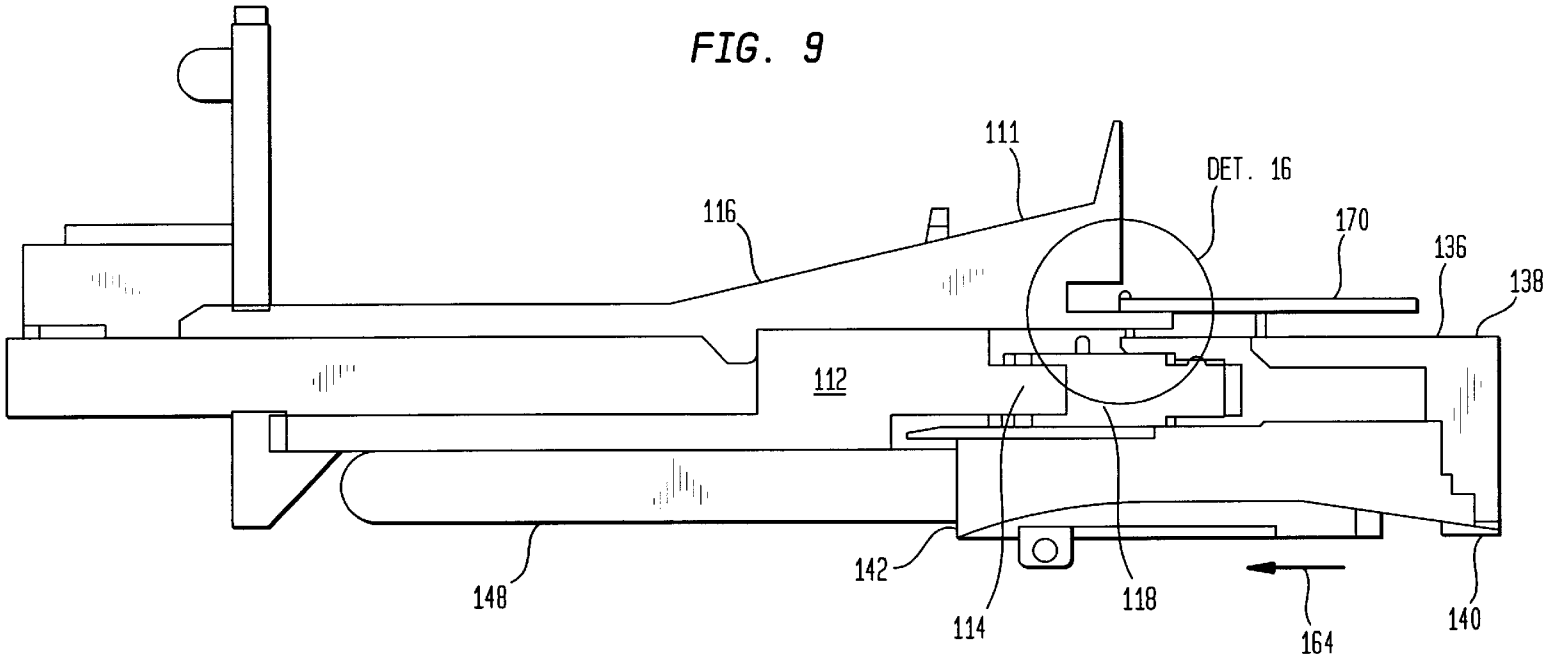
FIG. 9 is a side elevational view of another cable organizer, showing the patchcord plug of FIG. 5 connected to the wiring block assembly.

A cover 150 is attached to the body 138. The cover 150 extends between opposite proximal 152 and distal 154 ends. The cover 150 is moveable between a first cover position covering the channel 144, as shown in FIG. 8, and a second cover position uncovering the channel 144, as shown in FIG. 5. The cover 150 includes a first surface 151 facing outward in the first cover position, and an opposite second surface 153 facing inward in the first cover position. In the first cover position, the plug 136 will be pulled through a trough without snagging on adjacent wiring. In the second cover position, the plug 136 will slide in a direction of engagement 164, as shown by arrow 164 in FIG. 9, to engage the connecting block 118 and thereby allow signals to be conducted between the connector 146 and the connecting block 118.

Figure 7:
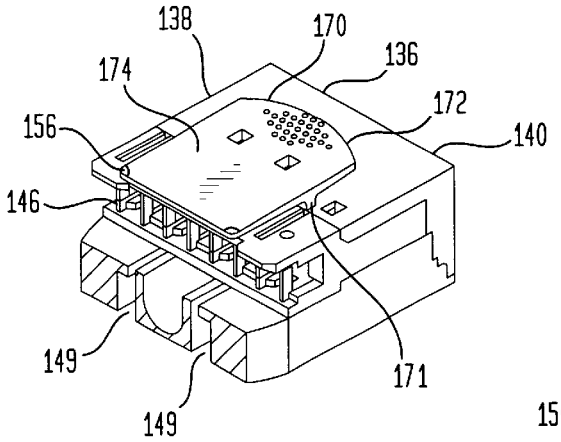
FIG. 7 is a perspective cross-sectional view of the plug of FIG. 5, taken along lines 14—14 of FIG. 6, with the cover removed, and showing the slots.
Figure 11:
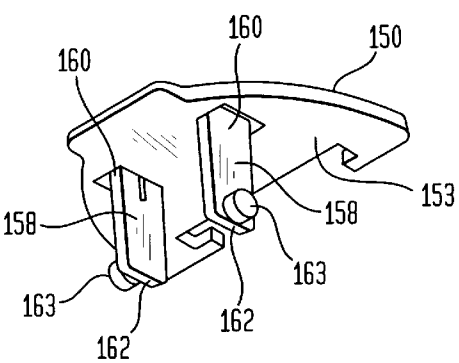
FIG. 11 is a perspective view of the cover of the patchcord plug of FIG. 5, taken along lines 17—17 of FIG. 5, showing the cover second surface and arms.
Figure 10:
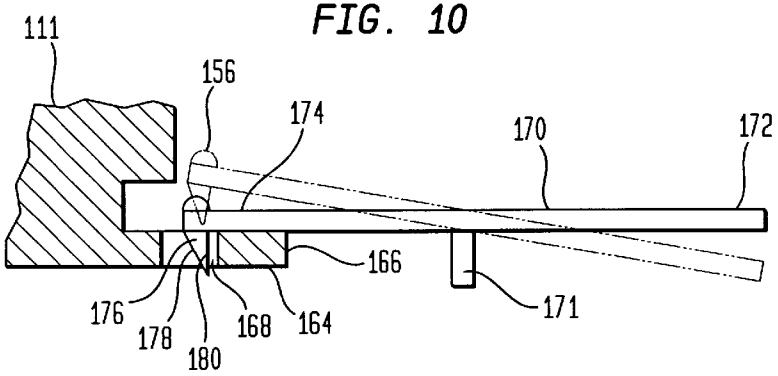
FIG. 10 is an enlarged, partial cross-sectional view of the latch and strike of the patchcord plug of FIG. 5, taken at detail 16 of FIG. 9.

Referring now to FIGS. 10, and 11, as well as to FIGS. 5, 6, 7, 8, and 9, pivotal means is provided for pivotal attachment of the cover 150 to the body 138. Typically, the pivotal means comprises at least one, and preferably two arms 158, as shown in FIG. 11. The arms 158 each extend between a proximal end 160 attached to the cover second surface 153 and an opposite distal end 162 having a pivot knob 163. The body 138 includes at least one, and preferably two slots 149, as shown in FIG. 7. The cover 150 is juxtaposed with the slots 149, and each one of the pivot knobs 163 engages one of the slots 149.

Plug retaining means is provided for releasably retaining the patchcord plug 136 on the wiring block assembly 111. Specifically, a strike 164 projects outward from the wiring block assembly 111 adjacent the plug 136. The strike 164 has front 166 and rear 168 faces disposed transversely to the direction of engagement with strike 164.

A latch 170 is resiliently attached to the plug 136. The resilient attachment is shown at 171. The latch 170 extends between opposite proximal 172 and distal 174 ends. The latch 170 has a hook 176 movable transversely to the direction of engagement with strike 164. The hook 176 has front 178 and rear 180 faces disposed transversely to the direction of engagement with strike 164. The latch 170 is attached to the body 138 intermediate between the latch proximal 172 and distal 174 ends. The latch distal end 174 is adjacent the cover proximal end 152.

A cover retaining means is provided for releasably retaining the cover 150 in the first cover position. Specifically, the cover retaining means is a detent 156 integral with the latch distal end 174 for receiving the cover proximal end 152.

Thus, as the plug 136 slides into engagement with the wiring block assembly 111, the hook front face 178 will engage the strike front face 166. The latch 170 will deflect resiliently away from the strike 164, as shown in FIG. 10. The hook rear face 180 will then engage the strike rear face 168, thereby retaining the plug 136. As the plug 136 is withdrawn from engagement with the wiring block assembly 111, the latch 170 will be manually depressed as shown in FIG. 10, releasing the hook rear face 180 from engagement with the strike rear face 168, thereby releasing the plug 136.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications which will come within the scope of the appended claims is reserved.

What is claimed:

1. A reverse-engaging patchcord plug, for use in connection with a wiring block assembly having a connecting block, the patchcord plug comprising:

a body extending between opposite first and second ends, the body having a channel facing toward the body second end;

at least one connector mounted within the channel;

a conductor cord attached to the connector and projecting from the body second end, for conducting signals to the connector;

a cover attached to the body, the cover extending between opposite proximal and distal ends, the cover being moveable between a first cover position covering the channel and a second cover position uncovering the channel, the cover having a first surface facing outward in the first cover position and an opposite second surface facing inward in the first cover position; and pivotal means for pivotal attachment of the cover to the body, the body including at least one slot, the pivotal means comprising at least one arm extending between a proximal end attached to the cover second surface and an opposite distal end having a pivot knob, the cover being juxtaposed with the slot, the pivot knob engaging the slot.

2. The patchcord plug of claim 1, further comprising:

cover retaining means for releasably retaining the cover in the first cover position; and plug retaining means for releasably retaining the patchcord plug on the wiring block assembly.

3. The patchcord plug of claim 2, wherein the plug retaining means further comprises:

a strike projecting outward from the wiring block assembly adjacent the plug, the strike having a rear face disposed transversely to the direction of engagement; and a latch attached to the plug, the latch having a hook movable transversely to the direction of engagement, the hook having a rear face disposed transversely to the direction of engagement; so that with the patchcord plug engaging the wiring block assembly, the hook rear face will engage the strike rear face.

4. The patchcord plug of claim 3, wherein the cover retaining means further comprises a detent integral with the latch for receiving the cover proximal end.

5. The patchcord plug of claim 2, wherein the cover retaining means further comprises a detent integral with the body for receiving the cover distal end.

6. A reverse-engaging patchcord plug, for use in connection with a wiring block assembly having a cable organizer, an index strip, a connecting block, and a cable cover, the patchcord plug comprising:

a body extending between opposite first and second ends, the body having a channel facing toward the body second end;

at least one connector mounted within the channel;

a conductor cord attached to the connector and projecting from the body second end, for conducting signals to the connector;

a cover attached to the body, the cover extending between opposite proximal and distal ends, the cover being moveable between a first cover position covering the channel and a second cover position uncovering the channel, the cover having a first surface facing outward in the first cover position and an opposite second surface inward in the first cover position;

cover retaining means for releasably retaining the cover in the first cover position;

pivotal means for pivotal attachment of the cover to the body; and plug retaining means for releasably retaining the patchcord plug on the wiring block assembly;

wherein the body includes at least one slot; and the pivotal means comprises at least one arm extending between a proximal end attached to the cover second surface and an opposite distal end having a pivot knob, the cover being juxtaposed with the slot, the pivot knob engaging the slot.

7. A reverse-engaging patchcord plug, for use in connection with a wiring block assembly having a cable organizer, an index strip, a connecting block, and a cable cover, the patchcord plug comprising:

a body extending between opposite first and second ends, the body having a channel facing toward the body second end;

at least one connector mounted within the channel;

a conductor cord attached to the connector and projecting from the body second end, for conducting signals to the connector;

a cover attached to the body, the cover extending between opposite proximal and distal ends, the cover being moveable between a first cover position covering the channel and a second cover position uncovering the channel, the cover having a first surface facing outward in the first cover position and an opposite second surface inward in the first cover position;

cover retaining means for releasably retaining the cover in the first cover position, the cover retaining means comprising a detent integral with the latch distal end for receiving the cover proximal end;

pivotal means for pivotal attachment of the cover to the body; and plug retaining means for releasably retaining the patchcord plug on the wiring block assembly, wherein the plug retaining means comprises:

a strike projecting outward from the wiring block assembly adjacent the plug, the strike having front and rear faces disposed transversely to the direction of engagement; and a latch resiliently attached to the plug, the latch extending between opposite proximal and distal ends, the latch having a hook movable transversely to the direction of engagement, the hook having front and rear faces disposed transversely to the direction of engagement; so that as the plug slides into engagement with the wiring block assembly, the hook front face will engage the strike front face, the latch will deflect resiliently away from the strike, and the hook rear face will engage the strike rear face, thereby retaining the plug, and as the plug is withdrawn from engagement with the wiring block assembly, the latch will be manually depressed, releasing the hook rear face from engagement with the strike rear face, thereby releasing the plug.

8. The patchcord plug of claim 7, wherein the latch is attached to the body intermediate the latch proximal and distal ends, and the latch distal end is adjacent the cover proximal end.

9. The patchcord plug of claim 6, wherein the cover retaining means further comprises a detent integral with the body second end for receiving the cover distal end.

* * * * *